United States Patent [19]

Bayerl

[11] 4,121,611

[45] Oct. 24, 1978

[54] JET PIPE FOR CONDUCTING HOT GASES

[75] Inventor: Hermann Bayerl, Karlsfeld, Germany

[73] Assignee: MtU-Motoren-und Munchen GmbH, Munich, Germany

[21] Appl. No.: 766,778

[22] Filed: Feb. 8, 1977

[30] Foreign Application Priority Data

Feb. 14, 1976 [DE] Fed. Rep. of Germany ..... 2606005

[51] Int. Cl.[2] ..... F16K 49/00

[52] U.S. Cl. ..... 137/340; 165/154

[58] Field of Search ..... 137/340; 165/140, 141, 165/154; 73/116, 117.4

[56] References Cited

U.S. PATENT DOCUMENTS

| | | | |
|---|---|---|---|
| 1,219,501 | 3/1917 | Stevens | 137/340 |
| 2,705,016 | 3/1955 | Saar | 165/47 |
| 2,811,981 | 11/1957 | Harris | 137/340 |
| 2,942,855 | 6/1960 | Wellensiek | 165/154 |
| 3,430,689 | 3/1969 | Pantke et al. | 137/340 |
| 3,450,195 | 6/1969 | Schnacke | 165/47 |
| 3,941,186 | 3/1976 | Schneider | 137/340 |

*Primary Examiner*—Martin P. Schwadron
*Assistant Examiner*—A. Michael Chambers
*Attorney, Agent, or Firm*—Haseltine, Lake, & Waters

[57] ABSTRACT

A jet pipe for the supply of hot gases formed with a double wall for the passage of cooling means, and where the jet pipe has a longitudinal axis, includes a throttle valve which may be rotated about an axis transverse to the jet pipe longitudinal axis. The jet pipe may be partitioned along a plane including the axis transverse to the longitudinal axis. The jet pipe includes a first segment disposed ahead of the partition plane, and a second segment disposed behind the partition plane. The first and second segments serve for circulation of the cooling means, and are separated from one another.

7 Claims, 6 Drawing Figures

JET PIPE FOR CONDUCTING HOT GASES

FIELD OF THE INVENTION

The present invention relates to a jet pipe for conducting hot gases, the jet pipe being formed with double walls for the purpose of passing cooling means, preferably water therethrough, and includes a throttle valve, which is pivotable about an axis which is disposed transversely to the longitudinal axis of the jet pipe.

SUMMARY OF THE INVENTION

Jet pipes of the initially described kind are used, for example, for testing the combustion chamber of gas turbine jet plants, the pivotable throttle valve acting as a simulator of a turbine postcoupled to the combustion chamber.

Jet pipes of this type are therefore exposed to relatively high and frequently varying temperatures.

It is in principle known to cool construction elements exposed to temperature stress, i.e. by the use of air- or water-cooling means.

In practice, it has been shown, however, that considerable difficulties exist, inspite of the cooling of the construction elements exposed to stress, to control temperatures which arise in modern gas turbine power plants, for example, to control a turbine entry temperature of 1200° C. or higher; differing material accumulations on the construction parts exposed to stress have led to thermal stresses and cracks in the material.

Furthermore, considerable scaling has resulted in the construction elements exposed to stress, in spite of the cooling of the latter, at operating temperatures of about 800° C.

Particularly if water has been used as cooling means, difficulties have continued to exist, to economically meet the desired high temperatures stresses, as well as the temperature fluctuations; i.e. a plant of the aforesaid kind could not be made operative, until, for example, damage which has occurred by high temperature stress is locally repairable; this applies particularly for the jet pipe region on the side of the throttle valve, where its pivoting mechanism, for example the mechanism in addition to the throttle valve is exposed to the risk of damage due to high temperature.

OBJECT OF THE INVENTION

It is an object of the present invention to obviate these known disadvantages, and to create a jet pipe of the initially described kind, which can meet the requirements with respect to optimal cooling even when exposed to relatively considerable temperature variation of hot gases.

To obtain the above objective it is proposed, according to the invention, that the jet pipe be separable in the plane of the rotating axis of the throttle valve, respective separate cooling water circulation systems being associated with respective jet pipe sections disposed ahead and behind the partition plane, and the throttle valve.

It is therefore feasible to associate the most suitable cooling device guidance means with the individual jet pipe sections as well as with the throttle valve, taking into account their disposition and their form factor, as well as taking into account the temperature stress to be expected by the jet pipe sections and the throttle valve. Furthermore, the throughput of a respective cooling means can be separately controllable for the jet pipe section and for the throttle valve.

In the event of a defect it is further possible to exchange the throttle valves, or a section of the pipe inclusive of the associated cooling system.

This exchangeability is particularly advantageous, since modified jet pipe construction groups, for example a purely cylindrical tube section, may be substituted for another tube section having a diameter increasing in the direction of the gas flow, in view of the changed or modified thermodynamic conditions.

BRIEF DESCRIPTION OF THE DRAWING

The present invention is further illustrated in the drawing including features further defining the invention by way of example; thus.

DESCRIPTION OF THE PREFERRED EMBODIMENTS

Figure 1:
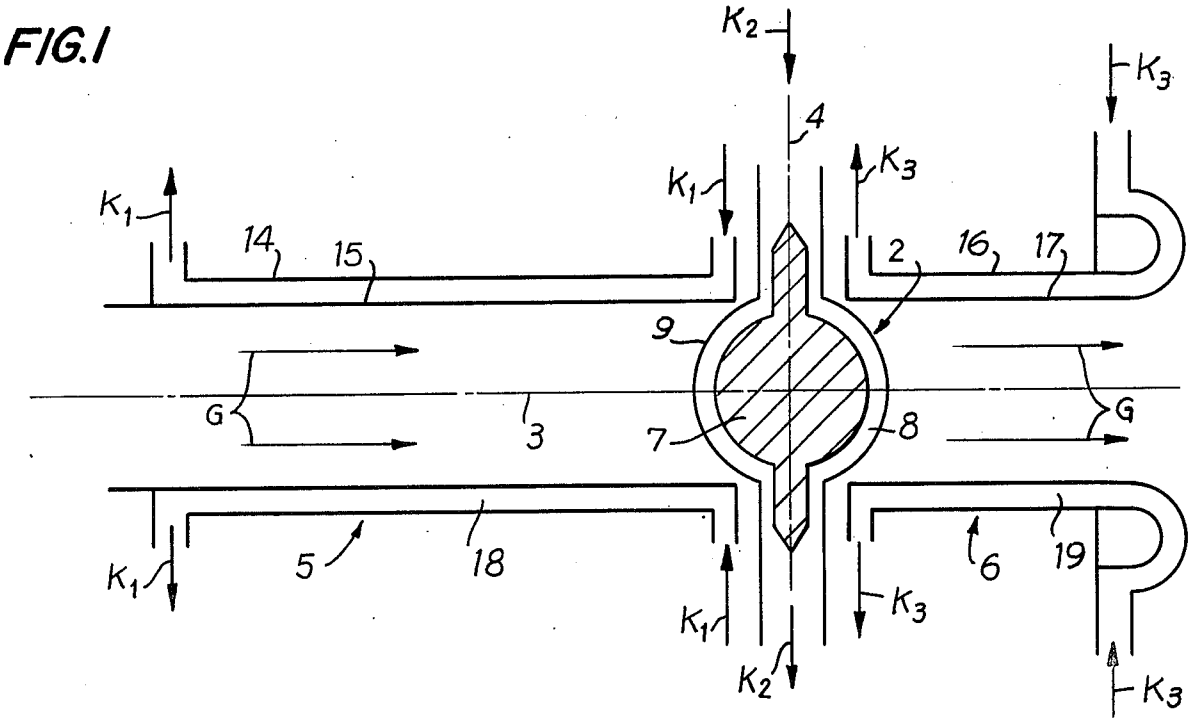
FIG. 1 shows schematically a jet pipe sectioned along the longitudinal center plane.

FIG. 1 shows schematically a jet pipe for conducting hot gases, which is formed with double walls for the passage of a cooling means, preferably water, and has a throttle valve 2, which is pivotable about an axis 4, the latter being transverse to the longitudinal axis 3 of the jet pipe. The jet pipe may be separable in the plane of the pivotable axis 4 of the throttle valve 2, separate cooling-water circulation means being associated with the jet pipe sections 5 and 6 disposed ahead and behind of the partition plane, and the throttle valve 2, respectively.

The throttle valve 2 is, for example, disposed in a horizontal position, in which the hot air stream (arrow G) may freely flow from the tube section 5 through the throttle valve 2, and therefrom to the jet pipe section 6.

The respective cooling water circulation is shown sequentially and schematically for the jet pipe section 5, the throttle valve 2, as well as for the jet pipe section 6 by means of the arrows $K_1$, $K_2$, as well as $K_3$.

The throttle valve 2 consists essentially of a throttle core 7, and an outer cover 9 enveloping the latter, a gap for a cooling means 8 being formed therebetween.

Figure 3:
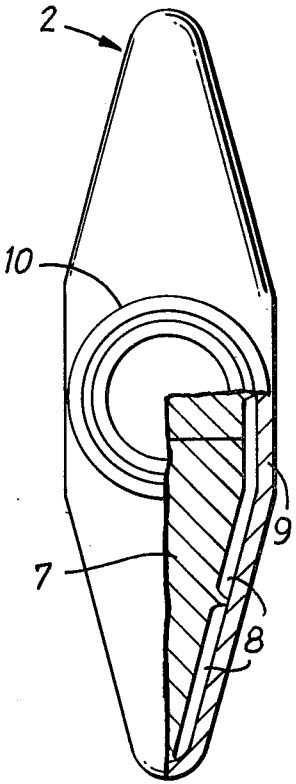
FIG. 3 shows the sideview of the throttle valve along the arrow X of FIG. 2, also partially sectioned longitudinally.
Figure 2:
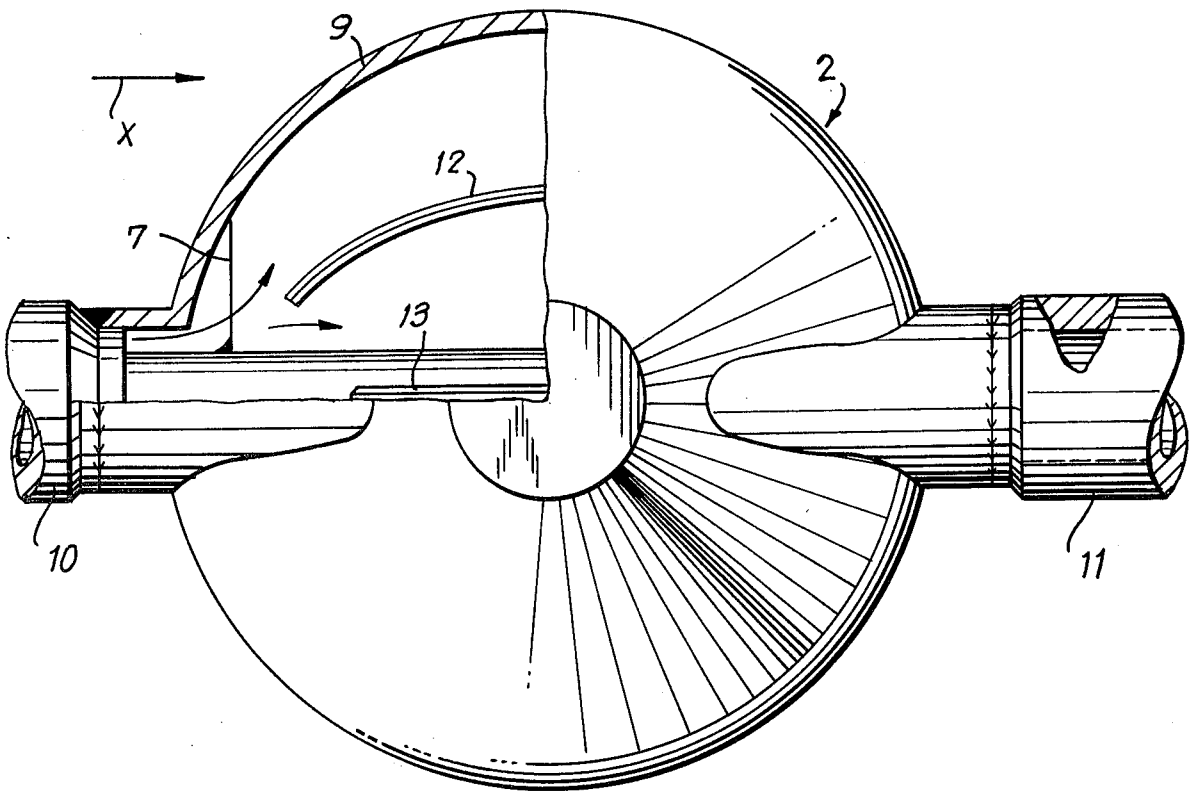
FIG. 2 shows the rear view of a throttle valve partially in section.

As can be further seen from FIGS. 2 and 3, the trunnions 10 and 11 of the throttle valve 2 can communicate as hollow cylindrical cooling means with the cooling center gap 8.

To ensure that there occurs as far as possible a uniform distribution of cooling means in the cooling gap 8, in a position of the throttle valve disposed transversely to the direction of the gas stream G, the core 7 of the throttle valve 2 is provided with guide ribs 12 and 13 extending over the whole surface thereof, which ribs divide the cooling center gap 8 into cooling center sectors disposed transversely to the direction of movement of the gas.

Figure 4:
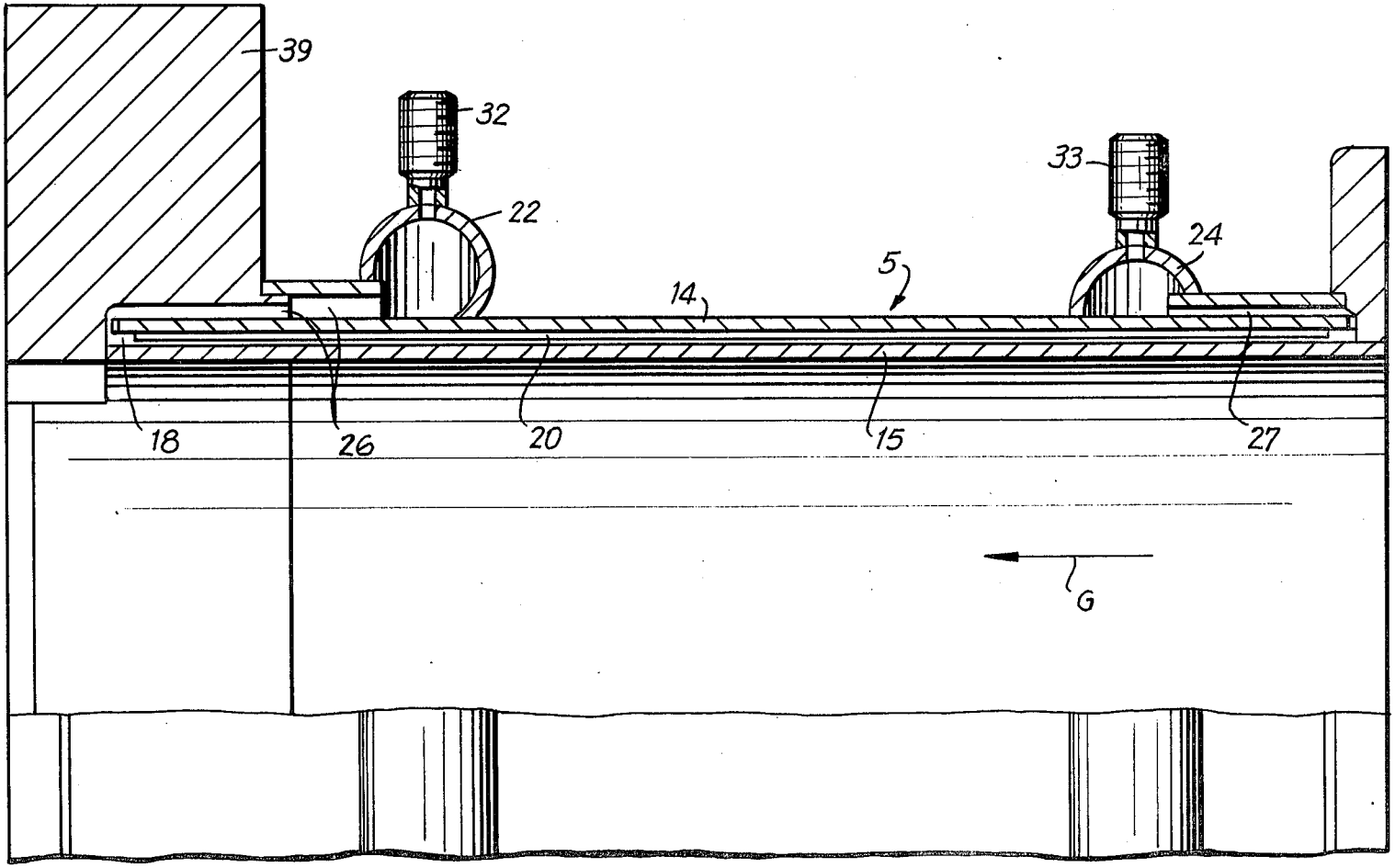
FIG. 4 is a partial cross-section of a broken-off jet pipe section to be disposed upstream of the throttle valve.
Figure 5:
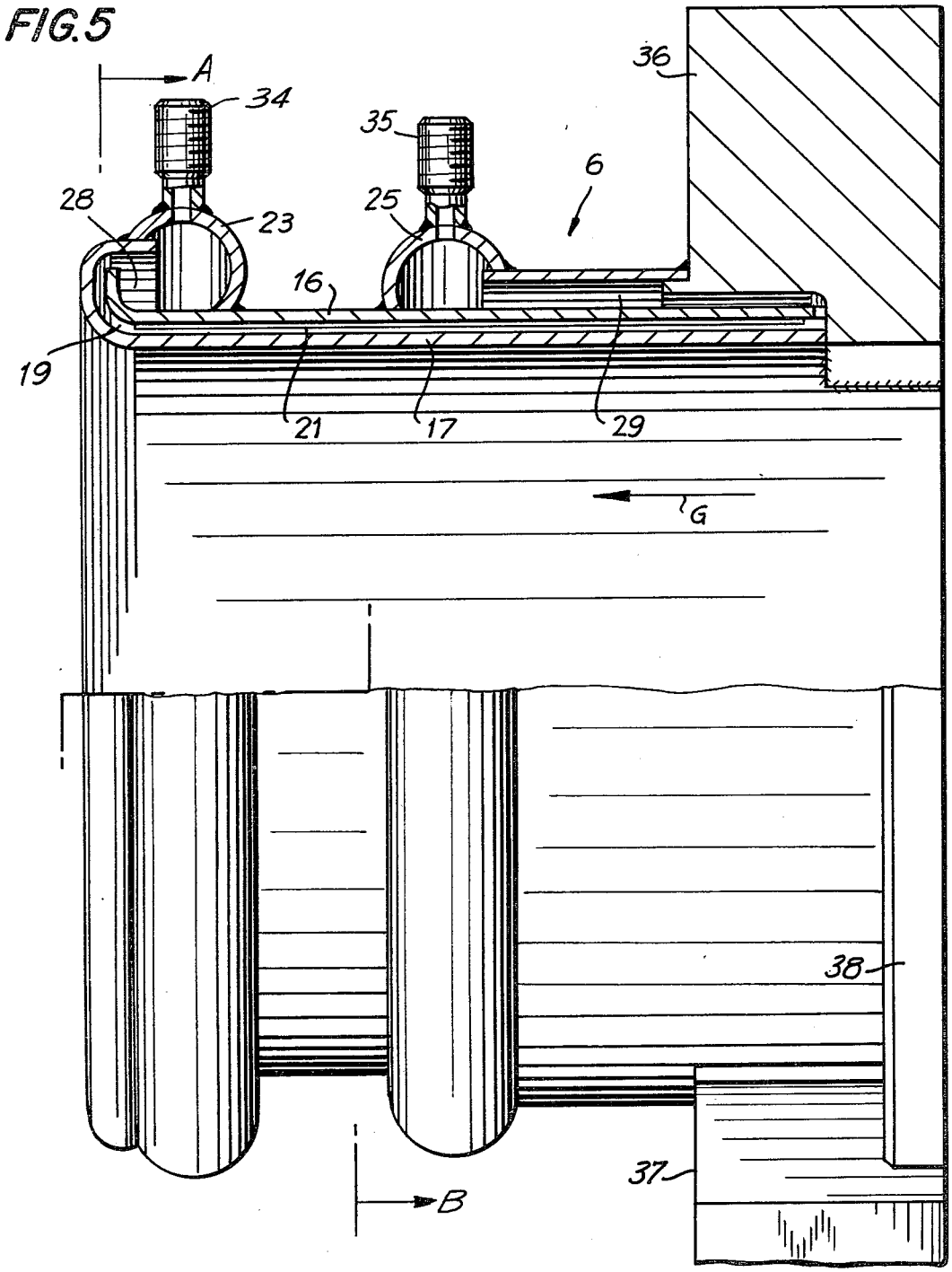
FIG. 5 is a longitudinal section of a jet-pipe section to be located downstream of the throttle valve.

Intermediate rods 20 may be disposed in the longitudinal direction of the tube within the cooling channels 18 and 19 (FIG. 1), the latter being formed within the respective inner and outer walls 15, 14 or 17 and 16 of a jet pipe segment 5 or 6, the rods 20 and 21 being seen in FIGS. 4 and 5. This feature is to ensure an optimal distribution of the cooling water with respect to the respective periphery or circumference of the jet pipe, and hence a uniform temperature distribution during the cooling process. According to FIGS. 4 and 5 the intermediate rods 20 or 21 are further attached to the respective outer walls 14 or 16 of a jet pipe segment 5 or 6, and are spaced with respect to the respective inner walls 15 and 17 radially from one another.

As can be further seen from FIGS. 4 and 5, supply tubes 22 or 23, and discharge tubes 24 or 25 are to be associated with the jet pipe segments 5 and 6 respectively, the supply- and discharge-pipes being disposed coaxially along the outer walls 14 or 16. Each supply and discharge tube communicates with the cooling channels 18 and 19 formed between the outer and inner wall via an associated annular space 26 or 27 (FIG. 4), and 28 or 29 (FIG. 5), the annular space being formed around the associated outer wall 14 or 16, at least over a portion of the entire tube length. The cooling means may be fed into the cooling channels 18 and 19 in a direction opposite to the direction of the gas stream, so as to intensify the cooling effect.

According to FIG. 5, the jet pipe segment 6 disposed behind the throttle valve 2 is formed by a segment of the inner wall 17 on the tube-end of a rotationally symmetrical segment curved outwardly in a collar-like fashion for a desired cooling of the temperature-vulnerable gas discharge edge, which segment constitutes together with the associated inlet tube 23 the annular space 28 provided for the admission of cooling means of the cooling channel 19. The cooling channel 19 projects into the annular space 28 in the direction of the end of the outer wall 16, the latter being at least partially bent outwardly in the direction of the inner wall 17.

Figure 6:
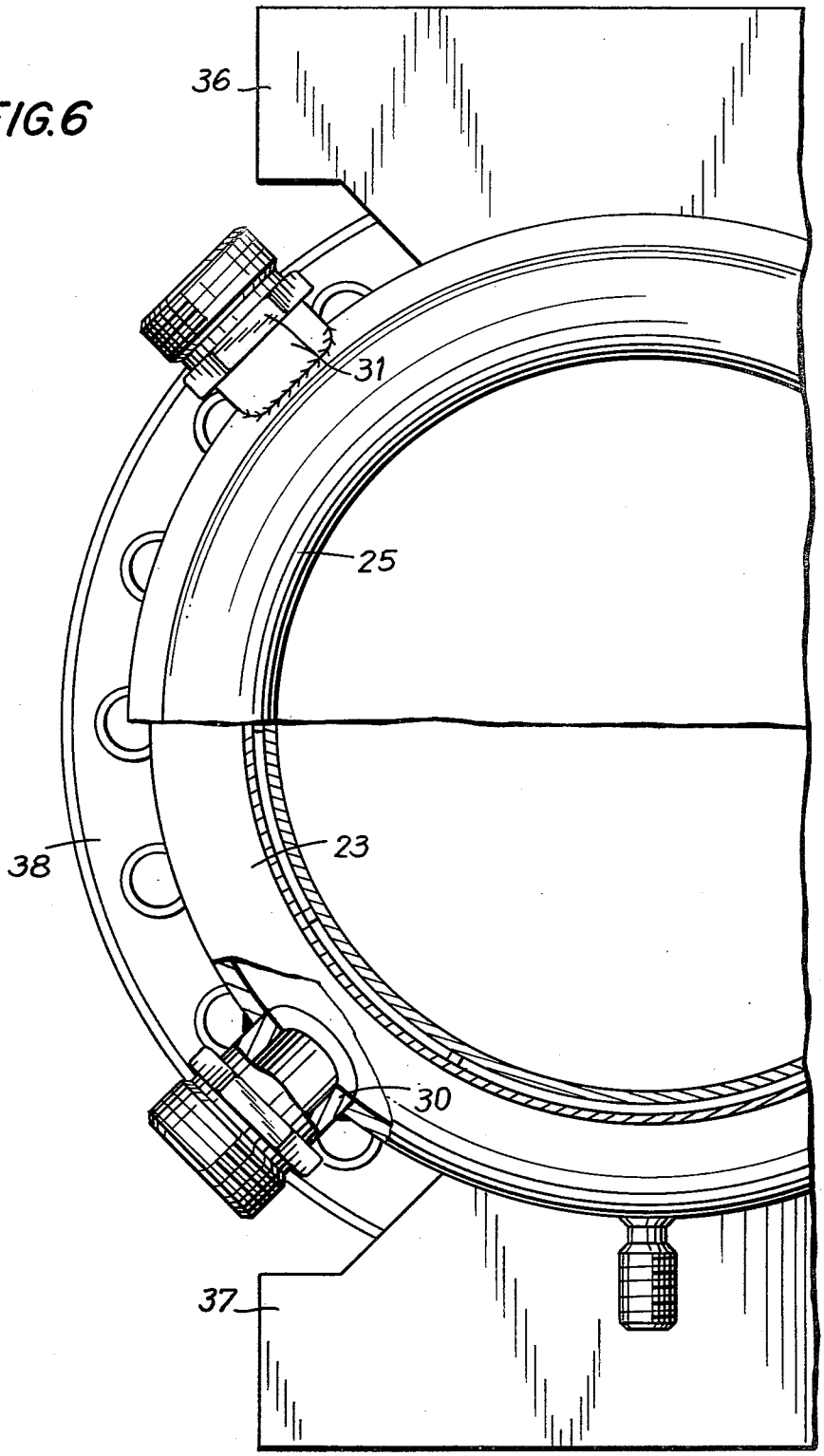
FIG. 6 shows a section of the tube along the line A-B of FIG. 5.

The supply and discharge tubes 22, 23, 24 and 25 may include a plurality of tubular connecting pieces arranged uniformly over their circumferences, respectively, for a uniform supply or discharge of the cooling means, as has been clarified for example in FIG. 6, by the tubular feed pipes 30 and 31 being disposed on the supply and discharge tubes 23 and 25, respectively.

As can be further seen from FIGS. 4 and 5, each supply and discharge tube 22 and 23, or 24 and 25, may be provided with at least one vent 32 or 33, or 34 and 35.

To compensate thermally caused material tensions on the throttle valve 2, the outer coating 9 of the throttle valve 2 may be disposed loosely on the trunnions 10 and 11, which are secured in a rotation-secure manner with the core 7.

Plugs 36 and 37 are shown in FIGS. 5 and 6, which plugs are provided with a connecting flange 38, and which also seal the end of the cooling channel 19 facing away from the discharge tube 25, as well as the annular space 29, with respect to the atmosphere.

This does of course also apply for the plug 39 disposed on the end of the tubular segment 5.

What is claimed is:

1. A jet pipe for the supply of hot gases formed with a double wall for the passage of cooling means, the jet pipe having a longitudinal axis, comprising: a throttle valve rotatable about an axis transverse to the jet pipe longitudinal axis, said jet pipe being partitionable along a plane including said axis transverse to the longitudinal axis, the jet pipe including a first segment disposed ahead of the partition plane, a second segment disposed behind the partition plane, said first and second segments serving for circulation of the cooling means, said segments being separated from one another, said throttle valve comprising a core, an outer shell uniformly surrounding said core, a gap being formed between said outer shell and said core for receiving the cooling means, and first and second hollow trunnions attached to said core, said hollow trunnions communicating with said gap for the cooling means, said core of said throttle valve having a plurality of guidance ribs extending substantially over the whole surface of said core, said guidance ribs subdividing said core into a plurality of substantially longitudinal cooling means sectors, said first and second segments being formed with longitudinal ducts, respectively, a gas stream being passable through said ducts in a predetermined direction, the longitudinal direction of said sectors being substantially transverse to the gas stream direction, said outer shell of said throttle valve being disposed loosely on said trunnions, said trunnions being attached to said core in a rotation-secure manner.

2. A jet pipe according to claim 1, wherein each of said segments is formed with longitudinal ducts, respectively, each of said ducts having inner and outer walls, and further including at least one rod disposed between the inner and outer walls of said duct.

3. A jet pipe according to claim 2 wherein said rod is attached to the outer wall of each of said ducts and spaced radially from the corresponding inner wall.

4. A jet pipe according to claim 2, further comprising discharge and supply pipes for the cooling means disposed coaxially along each of said ducts, there being formed annular supply conduits surrounding the outer wall of the jet pipe at least over a part of its whole length, said discharge and supply pipes communicating with said ducts, the cooling means being suppliable through the supply pipe, a gas stream being passable through the ducts in a predetermined direction, the direction of supply of the cooling means being opposite to the gas stream direction.

5. A jet pipe according to claim 4, wherein the jet pipe inner and outer walls form an end, the pipe end being disposed behind the throttle valve, the inner and outer walls of said pipe end being flared outwardly and, a coolant channel extending into said annular supply conduits.

6. A jet pipe according to claim 4, wherein said supply and discharge pipes have a plurality of ports uniformly distributed over their peripheries for uniform supply and discharge of cooling means.

7. A jet pipe according to claim 4, wherein each of said supply and discharge pipes includes at least one exhaust vent.

* * * * *